US005645469A

United States Patent [19]

Burke et al.

[11] Patent Number: 5,645,469

[45] Date of Patent: Jul. 8, 1997

[54] POLISHING PAD WITH RADIALLY EXTENDING TAPERED CHANNELS

[75] Inventors: Peter A. Burke; Bradley J. Yellitz, both of Austin, Tex.

[73] Assignee: Advanced Micro Devices, Inc., Sunnyvale, Calif.

[21] Appl. No.: 709,179

[22] Filed: Sep. 6, 1996

[51] Int. Cl.[6] ..... B24B 1/00

[52] U.S. Cl. ..... 451/41; 451/527; 451/283; 451/287

[58] Field of Search ..... 451/41, 450, 446, 451/283, 285, 287, 537, 527, 530, 548

[56] References Cited

U.S. PATENT DOCUMENTS

| | | | |
|---|---|---|---|
| 888,129 | 5/1908 | Tone | 451/527 |
| 2,242,877 | 5/1941 | Albertson | 451/527 |
| 2,653,428 | 9/1953 | Fuller | 451/527 |
| 2,749,681 | 6/1956 | Reidenbach | 451/527 |
| 4,715,150 | 12/1987 | Takeuchi et al. | 451/527 |
| 4,918,872 | 4/1990 | Sato et al. | 451/450 |
| 5,020,283 | 6/1991 | Tuttle | 51/209 |
| 5,131,190 | 7/1992 | Gougouyan | 451/283 |
| 5,137,597 | 8/1992 | Curry, II et al. | 156/636 |
| 5,142,828 | 9/1992 | Curry, II | 51/281 |
| 5,177,908 | 1/1993 | Tuttle | 51/283 |
| 5,216,843 | 6/1993 | Breivogel et al. | 51/131.1 |
| 5,297,364 | 3/1994 | Tuttle | 51/209 |
| 5,329,734 | 7/1994 | Yu | 451/41 |
| 5,380,546 | 1/1995 | Krishnan et al. | 427/126.1 |
| 5,394,655 | 3/1995 | Allen et al. | 451/41 |
| 5,441,598 | 8/1995 | Yu et al. | 156/645.1 |
| 5,558,563 | 9/1996 | Cote et al. | 451/287 |

*Primary Examiner*—James G. Smith
*Assistant Examiner*—Dona C. Edwards
*Attorney, Agent, or Firm*—Skjerven, Morrill, MacPherson, Franklin & Friel; David M. Sigmond

[57] ABSTRACT

A polishing pad having a polishing surface with radially extending tapered channels is disclosed. The polishing surface includes an inner radius within an outer radius, and the channels extend from the inner radius to the outer radius. Preferably, the outer radius is spaced from an outer circumferential edge of the polishing surface, the inner radius is an inner circumferential edge of the polishing surface, and the channels taper laterally and vertically at the outer radius. The channels are dimensioned and configured to direct slurry from the inner radius to the outer radius. The channels can be shaped with opposing sidewalls that are parallel in a first portion and diagonally converge in a second portion to form a sunburst pattern, or alternatively, with opposing sidewalls that continuously curve in a first rotational direction to form a starfish pattern. A polishing method includes positioning a wafer over the outer radius while introducing a slurry to facilitate polishing the wafer, and positioning the wafer inside the outer radius while introducing a cleaning fluid to facilitate cleaning the wafer.

49 Claims, 5 Drawing Sheets

POLISHING PAD WITH RADIALLY EXTENDING TAPERED CHANNELS

BACKGROUND OF THE INVENTION

1. Field of the Invention

The present invention relates to polishing, and more particularly to a polishing pad and a method for polishing semiconductor wafers.

2. Description of Related Art

In the manufacture of integrated circuits, the planarization of semiconductor wafers is becoming increasingly important as the number of layers used to form integrated circuits increases. For instance, metallization layers formed to provide interconnects between various devices may result in nonuniform surfaces. The surface nonuniformities may interfere with the optical resolution of subsequent lithographic steps, leading to difficulty with printing high resolution patterns. The surface nonuniformities may also interfere with step coverage of subsequently deposited metal layers and possibly cause open or shorted circuits.

Various techniques have been developed to planarize the top surface of a semiconductor wafer. One such approach involves polishing the wafer using a polishing slurry that includes abrasive particles mixed in a suspension agent. With this approach, the wafer is mounted in a wafer holder, a polishing pad has its polishing surface coated with the slurry, the pad and the wafer are rotated such that the wafer provides a planetary motion with respect to the pad, and the polishing surface is pressed against an exposed surface of the wafer. The polishing erodes the wafer surface, and the process continues until the wafer is largely flattened. Typically, the slurry is introduced near the center of the pad, forms a ring around the wafer and goes under the wafer as necessary. It is generally desirable to maintain an adequate amount of slurry between the wafer and the pad while dispensing as little slurry as possible to lower costs.

In chemical-mechanical polishing, the slurry particles abrade the wafer surface while a chemical reaction occurs at the wafer surface. For instance, in chemical-mechanical polishing of silicon dioxide, the slurry particles generate high pressure areas that cause the silicon dioxide to react with water. In chemical-mechanical polishing of other materials, such as tungsten, the slurry employs a wet chemical etchant to assist in removing wafer material. The wet chemical etchant is often more selective to the exposed wafer material than to underlying wafer materials.

The polishing pad can be a felt fiber fabric impregnated with polyurethane, with the amount of impregnation determining whether the pad is a "hard pad" or a "soft pad." A hard pad tends to focus the polishing pressure on protuding regions of the wafer surface in order to rapidly planarize the wafer surface. A soft pad tends to create a more even polish over the entire wafer surface, a finer surface finish, and less mechanical damage to the wafer.

Polishing pads with various topographies that improve the polishing operation are known in the art. In particular, polishing pads have been designed with channels, voids and the like in the polishing surface for reducing radially-dependent variations in the polishing rate. For instance, polishing pads may include voids that reduce radially-dependent variations in the surface contact rate. Alternatively, polishing pads may include circumferential or radial grooves that reduce radially-dependent variations in the slurry flow. The following are some examples.

U.S. Pat. No. 5,020,283 discloses a polishing pad containing circular voids in which the voids are substantially the same size but the frequency of voids increases with increasing radial distance. U.S. Pat. No. 5,177,908 discloses a polishing pad containing a sunburst pattern of nontapered rays, a polishing pad containing orthogonal channels in which the distance between channels decreases with increasing radius, and a polishing pad containing voids in which the void size increases with increasing radius. U.S. Pat. No. 5,394,655 discloses a polishing pad having a segmented circumferential strip near the outer circumferential edge, and another segmented circumferential strip near an inner circumferential edge, such that each circumferential strip encounters the edge of a wafer moved cycloidally with respect to the pad.

In other polishing pads, the polishing surface may include a series of circumferential grooves that direct the slurry between the pad and the wafer in order to prevent hydroplaning. These grooves are usually formed only on the portion of the polishing surface which contacts the wafer. U.S. Pat. No. 5,216,843 observes that circumferential macrogrooves become worn down over time. To alleviate this problem, the '843 patent utilizes a polishing apparatus that continually conditions the polishing pad by forming radial microgrooves in the pad while polishing occurs. The apparatus includes a diamond block holder with embedded diamond tipped threaded shanks that generate the microgrooves as a holder block is swept across the pad surface during polishing. The microgrooves are interconnected to one another and are 40 microns deep. There are several drawbacks to this approach. First, the conditioning apparatus requires special gearing and design to perform optimally. Furthermore, since the microgrooves have very small, uniform depths and widths, a significant amount of slurry can build up around the edges of the wafer and/or flow past the wafer and be wasted.

Accordingly, a need exists for a polishing pad and method of polishing which provides improved control over slurry and other fluids during polishing.

SUMMARY OF THE INVENTION

The invention provides an improved polishing pad and its method of use. The polishing pad includes a polishing surface with radially extending tapered channels. The polishing surface also includes an inner radius within an outer radius. The channels extend from the inner radius to the outer radius, and taper at the outer radius. The channels are dimensioned and configured to direct slurry from the inner radius to the outer radius, and to direct slurry up to the polishing surface at the outer radius. When a wafer is positioned over the outer radius and slurry is dispensed on the pad, a significant amount of slurry is directed between the wafer and the polishing pad instead of building up around the edge of the wafer or flowing past the wafer. In this manner, the channels facilitate slurry delivery during the polishing process. Furthermore, when the wafer is positioned inside the outer radius and cleaning fluid is dispensed on the pad, the cleaning fluid encounters a low pressure path and is rapidly directed between the wafer and the pad.

Accordingly, an object of the invention is to provide a polishing pad which facilitates the polishing process. Another object of the invention is a polishing pad which effectively directs slurry when the wafer is in a first position, and effectively directs cleaning fluid when the wafer is in a second position.

In one embodiment of the invention, a polishing pad comprises a polishing surface having an outer circumferential edge, an outer radius within the outer circumferential edge, and an inner radius within the outer radius. The polishing surface includes a plurality of similarly shaped, symmetrically spaced, radially extending tapered channels that extend from the inner radius to the outer radius. The channels have a first depth at the inner radius and a portion of gradually decreasing depth with increasing radius such that bottom surfaces of the channels intersect the polishing surface at the outer radius. The channels also have a first width at the inner radius and a portion of gradually decreasing width with increasing radius such that opposing sidewalls of the channels intersect one another at the outer radius.

The channels can include a first portion adjacent to the inner radius in which opposing sidewalls are parallel to one another, and a second portion adjacent to the outer radius in which the opposing sidewalls diagonally converge towards one another so that the channels form a sunburst pattern. Alternatively, the channels can have opposing sidewalls that curve in a first rotational direction and converge towards one another between the inner radius and the outer radius, so that the channels form a starfish pattern. The channels can also have a first depth extending through the first portion and a gradually decreasing depth with increasing radius extending through the second portion. Alternatively, the channels can have a gradually decreasing depth with increasing radius between the inner radius and the outer radius. Additionally, the channels can include spaced vertical abutments along their bottom surfaces to steer slurry in the direction normal to the polishing surface.

In accordance with another aspect of the invention, the inner radius is an inner circumferential edge of the polishing surface, the polishing surface includes a plurality of circumferential grooves between the outer radius and the outer circumferential edge, and the polishing surface includes a single circumferential trench between the inner radius and the outer radius which intersects the radially extending tapered channels. The circumferential trench has a substantially greater width and depth than that of the circumferential grooves, and assists the radially extending tapered channels with directing fluid towards the circumferential grooves.

The invention also includes a method of polishing a semiconductor wafer, comprising the steps of providing a polishing pad having a polishing surface comprising the radially extending tapered channels, mounting a semiconductor wafer on a wafer holder, rotating the wafer and the pad, introducing a slurry onto the polishing surface, and pressing the polishing surface against the wafer while the wafer covers the outer radius so that the channels direct the slurry from the inner radius to the outer radius thereby facilitating polishing the wafer.

The method may also comprise introducing a cleaning fluid onto the polishing surface, after introducing the slurry, and pressing the polishing surface against the wafer while the wafer is between the inner radius and the outer radius to expose the outer radius so that the channels direct the cleaning fluid from the inner radius to the outer radius along a low pressure path thereby facilitating cleaning the wafer.

These and other objects, features and advantages of the invention will be further described and more readily apparent from a review of the detailed description of the preferred embodiments which follow.

BRIEF DESCRIPTION OF THE DRAWINGS

The following detailed description of the preferred embodiments can best be understood when read in conjunction with the following drawings, in which.

Figure 2:
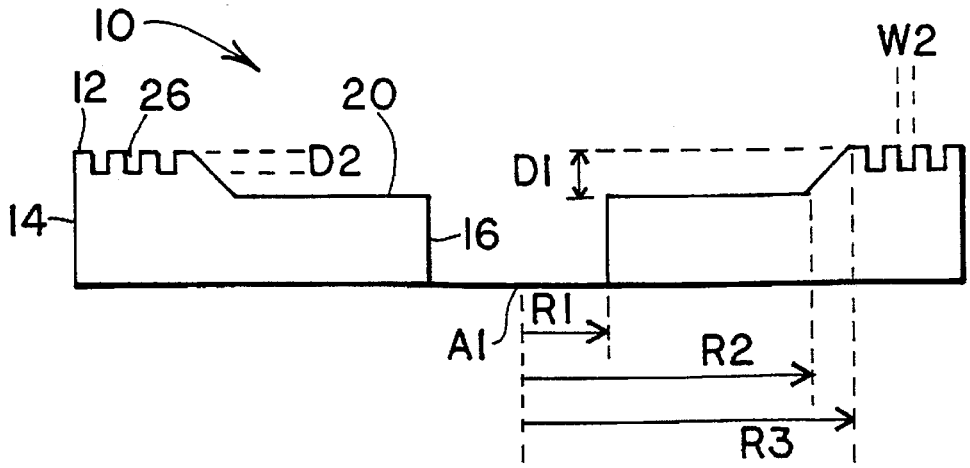
FIG. 2 shows a cross-sectional view of the polishing pad of FIG, 1.
Figure 4:
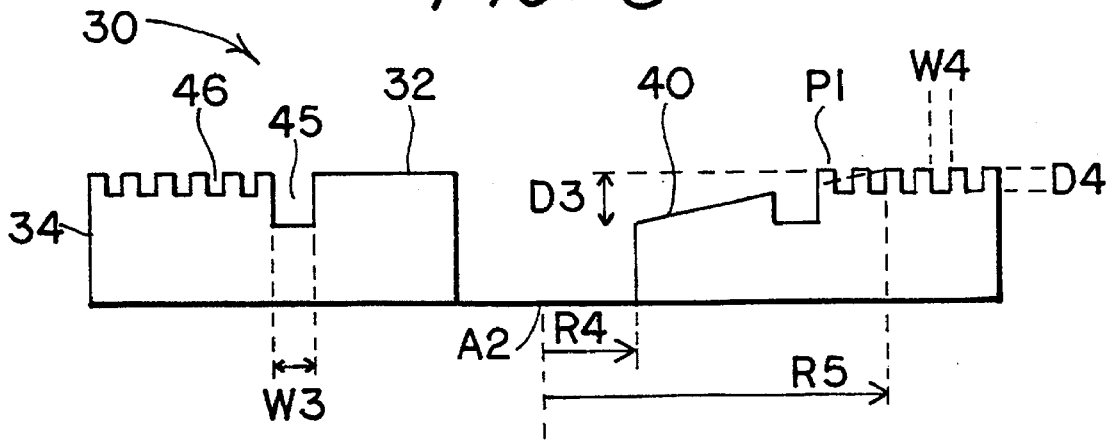
Figure 6:
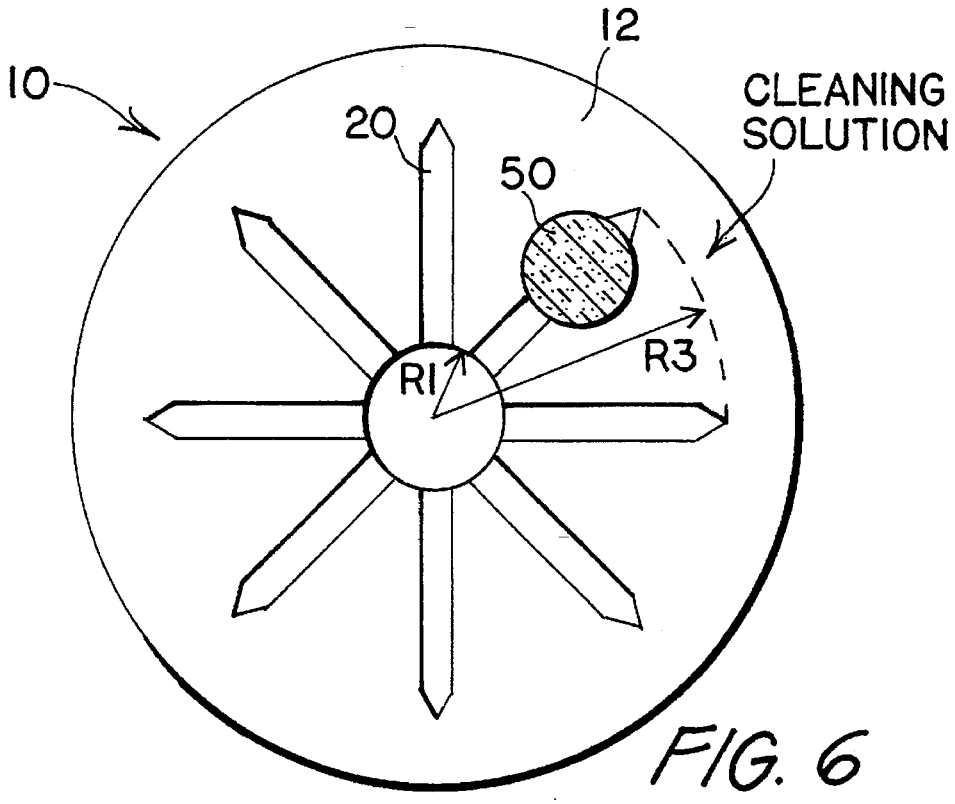
Figure 7:
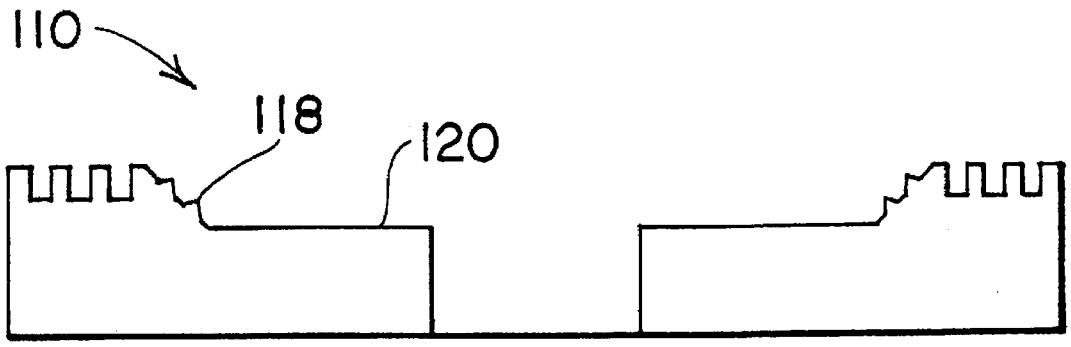
Figure 8:
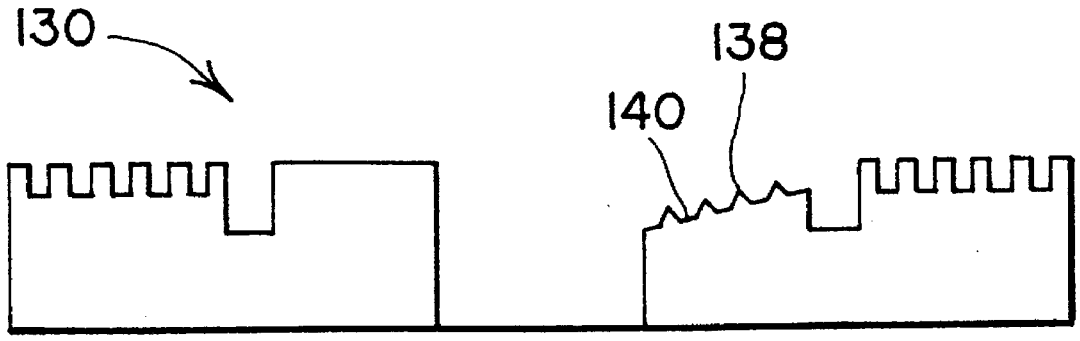
Figure 9:
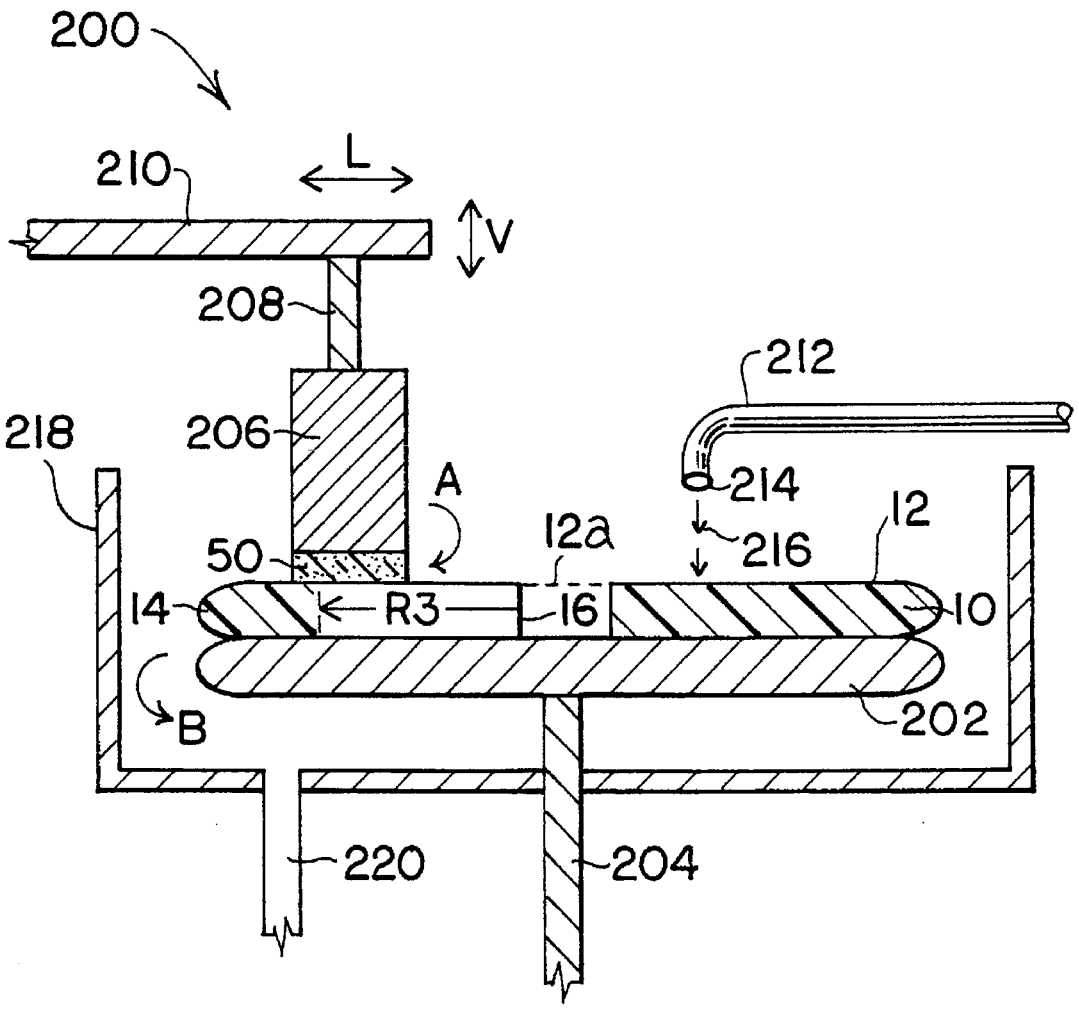

FIG, 3 shows a top plan view of another polishing pad according to an embodiment of the present invention;

FIG, 4 shows a cross-sectional view of the polishing pad of FIG, 3;

FIG, 5 shows a top plan view of a wafer positioned for receiving a slurry according to an embodiment of the present invention;

FIG. 6 shows a top plan view of a wafer positioned for receiving a cleaning fluid according to an embodiment the present invention;

FIG. 7 shows a cross-sectional view of vertical abutments in the radially extending tapered channels of a polishing pad similar to that shown in FIG. 2;

FIG. 8 shows a cross-sectional view of vertical abutments in the radially extending tapered channels of a polishing pad similar to that shown in FIG. 4; and FIG. 9 shows a cross-sectional view of a polishing system according to an embodiment of the present invention.

DETAILED DESCRIPTION OF THE PREFERRED EMBODIMENTS

In the drawings, depicted elements are not necessarily drawn to scale and like or similar elements may be designated by the same reference numeral throughout the several views.

Figure 1:
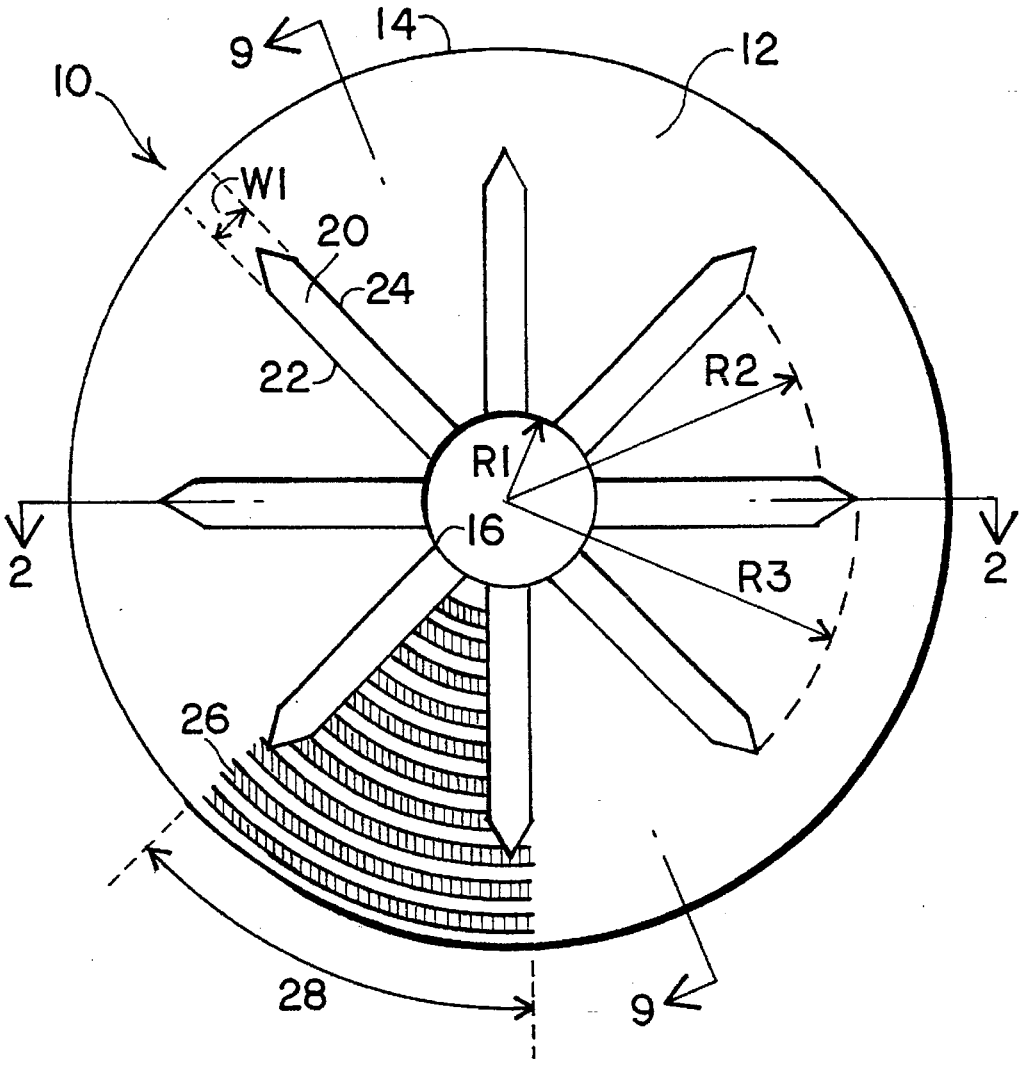
FIG. 1 shows a top plan view of a polishing pad according to an embodiment of the present invention.

FIG. 1 shows a top plan view of a polishing pad according to an embodiment of the present invention. Polishing pad 10 includes a planar polishing surface 12 in the form of an annular ring between an outer circumferential edge 14 and an inner circumferential edge 16. Polishing surface 12 includes an inner radius R1, a middle radius R2, and an outer radius R3. Inner radius R1 is defined by inner circumferential edge 16. Middle radius R2 is between and spaced from inner radius R1 and outer radius R3, but is closer to outer radius R3 than to inner radius R1. Outer radius R3 is spaced from and within outer circumferential edge 14. Polishing surface 12 includes a plurality of radially extending tapered channels 20 arranged in a sunburst pattern. Channels 20 extend between and have distal ends at inner radius R1 and outer radius R3. Channels 20 have similar shapes, and are symmetrically spaced from one another. Channels 20 include opposing sidewalls 22 and 24. Sidewalls 22 and 24 are straight and parallel to one another in a first portion extending from inner radius R1 to middle radius R2, remain straight but taper laterally by diagonally converging toward one another with increasing radius between middle radius R2 and outer radius R3, and intersect one another at outer radius R3. Thus, channels 20 have a constant width W1 in the first portion, and gradually decrease in width with increasing radius in the second portion. Polishing surface 12 also includes a plurality of circumferential grooves 26 on all surface regions outside channels 20. For convenience of illustration, circumferential grooves 26 are shown only in region 28.

FIG. 2 shows a cross-sectional view of polishing pad 10 taken along line 2—2. Inner radius R1, middle radius R2 and outer radius R3 extend from rotation axis A1 of pad 10. Channels 20 have a first depth D1 in the first portion extending from inner radius R1 to middle radius R2, and taper vertically with increasing radius between middle radius R2 and outer radius R3, such that the bottom surfaces of channels 20 intersect polishing surface 12 at outer radius R3. Thus, channels 20 have a constant depth in the first portion, and gradually decrease in depth with increasing radius in the second portion. Circumferential grooves 26 have a width W2 and a depth D2. Depth D1 is substantially greater than depth D2, and width W1 is substantially greater than width W2. As is seen, radially extending tapered channels 20 and circumferential grooves 26 constitute breaks in polishing surface 12, and the bottom surfaces of channels 20 and grooves 26 are nonpolishing surfaces.

During polishing, channels 20 direct slurry to outer radius R3. Furthermore, since channels 20 contain tapered ends spaced from outer circumferential edge 14, channels 20 increase the slurry flow at polishing surface 12 near outer radius R3.

Figure 3:
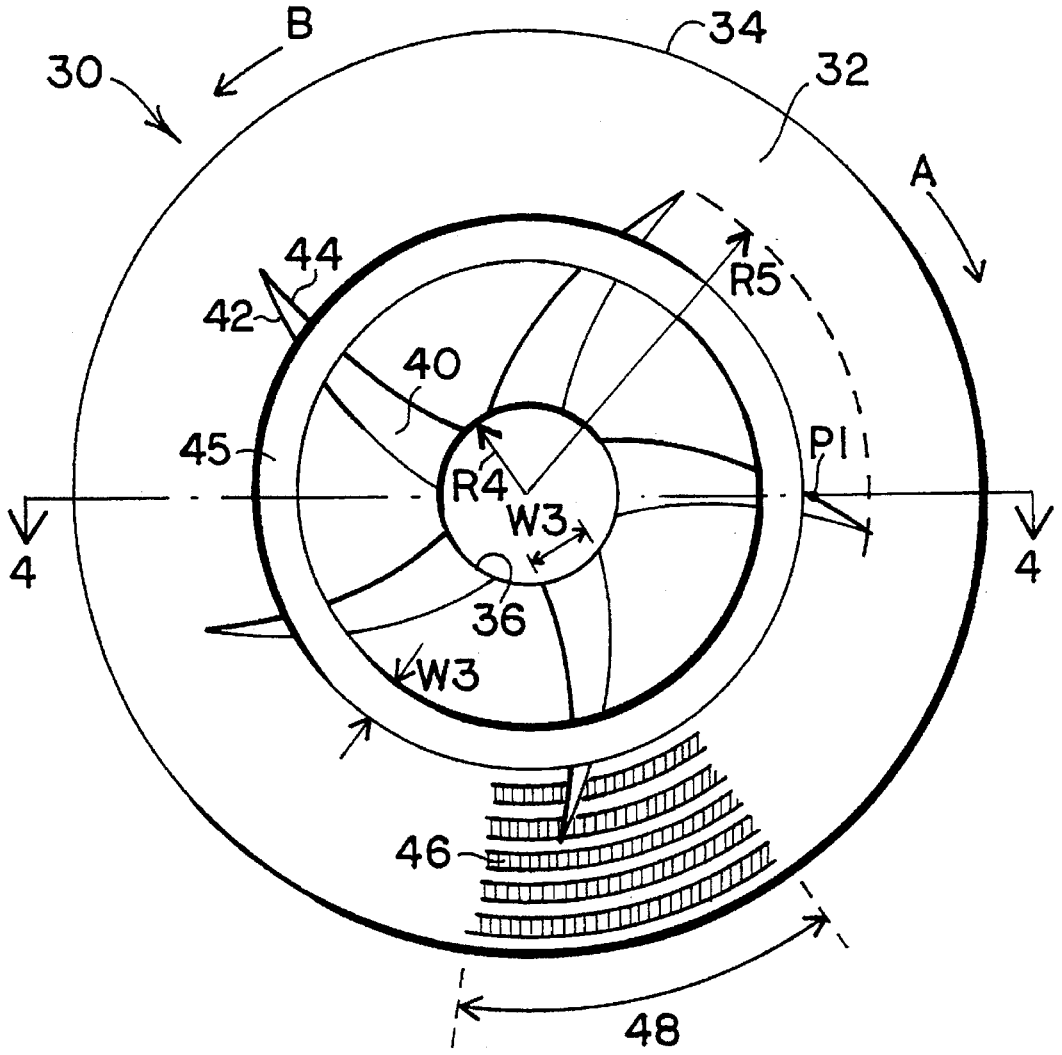

FIG. 3 shows a top plan view of another polishing pad according to an embodiment of the present invention. Polishing pad 30 includes a planar polishing surface 32 in the form of an annular ring between an outer circumferential edge 34 and an inner circumferential edge 36. Polishing surface 32 includes an inner radius R4 and an outer radius R5. Inner radius R4 is defined by inner circumferential edge 36. Outer radius R5 is spaced from and within outer circumferential edge 34. Polishing surface 32 includes a plurality of radially extending tapered channels 40 arranged in a starfish pattern. Channels 40 extend between and have distal ends at inner radius R4 and outer radius R5. Channels 40 have similar shapes, and are symmetrically spaced from one another. Channels 40 include opposing sidewalls 42 and 44. Sidewalls 42 and 44 continuously curve in a first rotational direction, shown as clockwise direction A, have a width that continuously tapers laterally with increasing radius between inner radius R4 and outer radius R5, and intersect one another at outer radius R5. Thus, channels 40 have a width W3 at inner radius R4 that gradually decreases with increasing radius. Polishing surface 32 also includes a circumferential trench 45 between inner radius R4 and outer radius R5. Circumferential trench 45 intersects channels 40, and has a width W3. Polishing surface 32 also includes a plurality of circumferential grooves 46 on all regions of polishing surface 32 between circumferential trench 45 and outer circumferential edge 34 outside channels 40. For convenience of illustration, circumferential grooves 46 are shown only in region 48.

FIG. 4 shows a cross-sectional view of polishing pad 30 taken along line 4—4. Inner radius R4 and outer radius R5 extend from rotation axis A2 of pad 30. Channels 40 have a third depth D3 at inner radius R4 and continuously taper vertically with increasing radius between inner radius R4 and outer radius R5, such that bottom surfaces of channels 40 intersect polishing surface 32 at outer radius R5. For illustration purposes, the slopes of channels 40 between point P1 and outer radius R5, although not visible from this cross-sectional view, are depicted by the diagonal broken lines. Thus, channels 40 have a maximum depth D3 and a gradually decreasing depth with increasing radius. Circumferential trench 45 has a constant depth D3. Circumferential grooves 46 have a width W4 and a depth D4. Depth D3 is substantially greater than depth D4, and width W3 is substantially greater than width W4. As is seen, radially extending tapered channels 40, circumferential trench 45 and circumferential grooves 46 constitute breaks in polishing surface 32, and the bottom surfaces of channels 40, trench 45 and grooves 46 are nonpolishing surfaces.

During polishing, channels 40 assist in directing slurry to outer radius R5. Furthermore, since channels 40 contain tapered ends spaced from outer circumferential edge 34, channels 40 increase the slurry flow at polishing surface 32 near outer radius R5. In addition, pad 30 is rotated in counterclockwise direction B, opposite to clockwise direction A, to assist with pumping the slurry. Circumferential trench 45 assists in directing slurry to channels 40. Moreover, circumferential trench 45 allows for radially oscillating a wafer across polishing surface 32, so that the wafer partially extends over outer circumferential edge 34 at a first position and partially extends over the outer edge of trench 45 at a second position. In this manner, the center-to-edge uniformity of the wafer can be tailored as desired. Of course, the wafer could be radially oscillated in a similar manner between outer circumferential edge 34 and inner circumferential edge 36 in the absence of trench 45.

Figure 5:
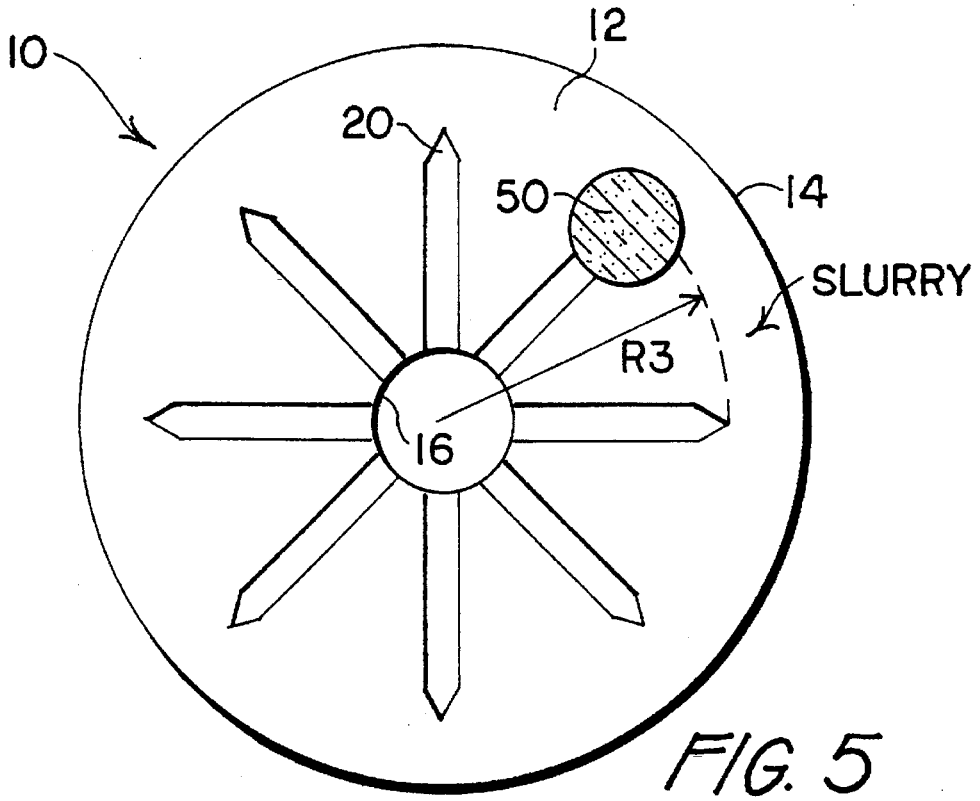

FIG. 5 shows a top plan view of a wafer positioned for receiving a slurry according to an embodiment of the present invention. In this embodiment, semiconductor wafer 50 is mounted on a rotating wafer holder (not shown), polishing pad 10 is also rotated, and a slurry is introduced onto polishing surface 12. Thereafter, wafer 50 is pressed against polishing surface 12 by applying a backside pressure on the order of 5 lbs per square inch. The surface of wafer 50 to be polished may include silicon, an insulating material, or a metal-containing material. Wafer 50 is spaced from circumferential edges 14 and 16. Furthermore, wafer 50 is positioned to cover outer radius R3 (and therefore cover the tapered ends of channels 20). Thus, channels 20 direct slurry between polishing surface 12 and wafer 50, and the slurry flowing out of the tapered ends of channels 20 is directed towards wafer 50. As a result, channels 20 increase the amount of slurry that contacts the polished surface of wafer 50, and decrease the amount of slurry that is slung off the pad without forming abrasive contact with wafer 50.

FIG. 6 shows a top plan view of a wafer positioned for receiving a cleaning fluid according to an embodiment of the present invention. This embodiment is similar to the embodiment of FIG. 5, except that a cleaning solution such as water is introduced onto polishing surface 12, and wafer 50 is positioned between inner radius R1 and outer radius R3 in order to expose outer radius R3. As a result, channels 20 rapidly direct the cleaning fluid between polishing surface 12 and wafer 50, and a large amount of the cleaning fluid flows through the tapered ends and is slung off the pad to expedite the cleaning operation. By exposing the tapered ends of the channels, the cleaning fluid has a low pressure path that permits rapid fluid flow. The cleaning fluid is typically introduced onto the pad after the wafer is polished and planarized, but before the wafer is separated from the pad, in order to clean the slurry and other contaminants off the wafer and out of the channels. Cleaning the channels is important since removing the wafer from the pad may create suction which draws loose materials from the channels onto the wafer.

FIG. 7 shows a cross-sectional view of another embodiment of the invention in which the radially extending tapered channels include spaced vertical abutments. In FIG. 7, the cross-sectional view is taken along a polishing pad 110, identical to pad 10, except that polishing pad 110 includes spaced vertical abutments 118 evenly distributed along the radial length of the vertically tapering portion of the bottom surfaces of channels 120. Therefore the vertically tapering portion of channels 120 has a substantially decreasing depth as the radius increases, consisting of a constantly decreasing depth interrupted by vertical abutments 118.

FIG. 8 shows a cross-sectional view of another embodiment of the invention in which the radially extending tapered channels includes spaced vertical abutments. In FIG.

8, the cross-sectional view is taken along a polishing pad 130, identical to pad 30, except that polishing pad 130 includes spaced vertical abutments 138 evenly distributed along the radial length of the bottom surfaces of channels 140. Therefore channels 140 have a substantially decreasing depth as the radius increases, consisting of a constantly decreasing depth interrupted by vertical abutments 138. The vertical abutments assist in directing slurry in a direction normal to the polishing surface before the slurry reaches the outer radius. Similarly, the vertical abutments provide "speed bumps" which slow down the radial flow rate of the slurry. It should be noted, however, that the vertical abutments do not extend to the polishing surface. Furthermore, the cleaning fluid typically has a much higher flow rate than the slurry. Advantageously, the vertical abutments provide less vertical directing or obstruction to the flow path as the flow rate increases, thereby preserving the low pressure flow path for the cleaning fluid when the outer radius is exposed.

The polishing pads of the present invention can be fabricated using conventional pad-forming equipment. As one approach, hot liquidous polyurethane is poured into a large cylindrical form to create a cake, the cake is cured, individual pads are sliced off the cake using a skiver, and the channels are formed by machining the pads using a mill or a lathe. As another approach, the chemicals that form a polyurethane polishing pad are introduced into a stainless steel mold, a polyurethane sheet is formed with a topography that is an inverse image of the mold surfaces, and the polyurethane sheet is removed from the mold and cut at circumferential edges to form the polishing pad. Preferably, the channels are recessed regions formed partially through a single layer of material, as opposed to perforations formed completely through a first layer which is subsequently adhered to a second layer, since the adhesive (such as glue) may contaminate the wafer during polishing.

As exemplary dimensions, the polishing pads have a thickness of 50 to 100 mils and a diameter of 32 inches, the outer radius is spaced from the outer circumferential edge by 1 to 6 inches, the middle radius is spaced from the outer circumferential edge by 7 to 10 inches and spaced from the outer radius by 4 inches, the inner radius is spaced from the radial center or rotation axis (A1, A2) by 1 inch, the radially extending tapered channels have a maximum width (W1) 0.25 to 1.5 inches, a maximum width (W3) of 1 to 3 inches, a maximum depth (D1, D3) of 20 to 90 mils, and a radial length (between the inner radius and the outer radius) of 9 to 14 inches, the circumferential trench has a width (W3) of 1 to 3 inches, a depth (D3) in the range of 20 to 90 mils and is spaced from the inner radius by 2.5 to 3.5 inches, the circumferential grooves have a width (W2, W4) of 10 mils, a pitch of 30 mils and a depth (D2, D4) of 15 mils, and the vertical abutments have a height of 1 to 10 mils. Of course, many of these dimensions are dependent on others.

FIG. 9 shows cross-sectional view of polishing system 200 for polishing a semiconductor wafer in accordance with an embodiment of the present invention. Polishing system 200 includes polishing pad 10 removably secured to rotatable platen 202. For ease of illustration, polishing pad 10 is shown along line 9—9 (see FIG. 1) such that channels 20 and grooves 26 are not shown, with polishing surface 12 behind inner circumferential edge 16 shown by broken lines 12*a*. Platen spindle 204 is fixed to the underside of platen 202. Wafer 50 has its backside (opposite the side to be polished) removably secured, such as by vacuum suction, to a wafer holder shown as chuck 206. Chuck spindle 208 is fixed to the top of chuck 206 and the bottom of polishing arm 210. Polishing arm 210 is movable both laterally (direction L) and vertically (direction V). Fluid dispenser 212 has outlet 214 positioned in close proximity to polishing surface 12 for dispensing a fluid (shown as arrows 216) onto polishing surface 12. Sink 218 provides containment for slung off materials that exit through drain 220.

A preferred operation of system 200 is now described. Initially, chuck spindle 208 rotates chuck 206 and wafer 50 in clockwise direction A, platen spindle 204 rotates platen 202 and pad 10 in counterclockwise direction B, polishing arm 210 holds wafer 50 above outer radius R3 and vertically spaced from polishing surface 12, and dispenser 212 dispenses slurry onto polishing surface 12. After contacting polishing surface 12, the slurry flows centrifugally toward outer circumferential edge 14 and is slung off the pad. Thereafter, polishing arm 210 is actuated downward so that wafer 50 is pressed against polishing surface 12 and covers outer radius R3. Polishing arm 210 continues to exert a downward pressure to enable pad 10 and the slurry to erode and polish wafer 50. Excess slurry and removed materials exit through drain 220. Periodically, an operator can retract polishing arm 210 to observe how the polishing is progressing. After the polished surface of wafer 50 is sufficiently smooth, dispenser 212 dispenses cleaning fluid instead of slurry, and polishing arm 210 is actuated laterally towards inner circumferential edge 16 so that wafer 50 is positioned within outer radius R3. In addition, polishing arm 210 continues to exert the downward pressure on wafer 50. As a result, the cleaning fluid rapidly flushes slurry and other contaminants on wafer 50 and pad 10 down drain 220. After the cleaning is finished, polishing arm 210 is actuated to remove wafer 50 from pad 10, deposit wafer 50 into an outlet cassette (not shown) and retrieve another wafer to be polished from an inlet cassette (not shown).

Variations to the embodiments of FIGS. 1–9 are apparent. For instance, the circumferential grooves can cover the entire polishing surface, or a portion of it, or be omitted entirely. Likewise, the circumferential trench can be used with polishing pad 10, and can be omitted from polishing pad 30. If desired, channels 20 can have a constantly decreasing depth with increasing radius between inner radius R1 and outer radius R3, and channels 40 can have a constant depth between a middle radius and inner radius R4 and a decreasing depth with increasing radius between the middle radius and outer radius R5. The inner radius and the outer radius can be located anywhere on the polishing surface, as long as the inner radius is within the outer radius. The radially extending tapered channels can have various configurations and various cross-sectional shapes such as triangular shapes, U-shapes, and sawtooth shapes. The vertical abutments can be located in regions of constant and/or decreasing depth in the channels. The number of radially extending tapered channels is preferably on the order of 10 to 20 per polishing pad. The hardness of the polishing pad is application dependent. The polishing pads can be disks instead of annular rings, thereby eliminating the inner circumferential edges, in which case the inner radius can be closer to or adjacent to the rotation axis for the pad. Other topographical patterns can be incorporated into the pads, for instance to reduce the radial dependency of the surface contact rate. The polishing pads are well-suited for polishing other workpieces besides semiconductor wafers. The polishing system can incorporate any polishing pad in accordance with the invention.

Other variations and modifications of the embodiments disclosed herein may be made based on the description set forth herein, without departing from the scope and spirit of the invention as set forth in the following claims.

What is claimed is:

1. A polishing pad, comprising:

a polishing surface comprising a plurality of radially extending tapered channels, wherein the polishing surface includes an inner radius within an outer radius, the channels extend from the inner radius to the outer radius, and the channels taper at the outer radius.

2. The polishing pad of claim 1, wherein the outer radius is spaced from an outer circumferential edge of the polishing surface.

3. The polishing pad of claim 1, wherein the inner radius is an inner circumferential edge of the polishing surface.

4. The polishing pad of claim 1, wherein the channels taper laterally at the outer radius.

5. The polishing pad of claim 1, wherein the channels taper vertically at the outer radius.

6. The polishing pad of claim 1, wherein the channels taper laterally and vertically at the outer radius.

7. The polishing pad of claim 1, wherein the polishing surface includes a middle radius between the inner radius and the outer radius, the channels have a substantially constant depth with increasing radius between the inner radius and the middle radius, and the channels have a substantially decreasing depth with increasing radius between the middle radius and the outer radius.

8. The polishing pad of claim 7, wherein the substantially decreasing depth includes spaced vertical abutments between regions of constantly decreasing depth.

9. The polishing pad of claim 1, wherein the channels have a substantially decreasing depth with increasing radius between the inner radius and the outer radius.

10. The polishing pad of claim 9, wherein the substantially decreasing depth includes spaced vertical abutments between regions of constantly decreasing depth.

11. The polishing pad of claim 1, wherein the polishing surface further includes a plurality of circumferential grooves outside the outer radius.

12. The polishing pad of claim 11, wherein the polishing surface further includes a single circumferential trench between inner radius and the outer radius, the circumferential trench has a substantially greater depth and a substantially greater width than any of the circumferential grooves, and the circumferential trench intersects the radially extending tapered channels.

13. The polishing pad of claim 1, wherein the channels have similar shapes and are symmetrically spaced from one another.

14. The polishing pad of claim 13, wherein the channels have opposing sidewalls that are parallel at a first portion adjacent to the inner radius and diagonally converge at a second portion adjacent to the outer radius.

15. The polishing pad of claim 14, wherein the channels form a sunburst pattern.

16. The polishing pad of claim 13, wherein the channels have opposing sidewalls that curve in a first rotational direction.

17. The polishing pad of claim 16, wherein the channels form a starfish pattern.

18. The polishing pad of claim 1, wherein the channels include bottom surfaces with spaced vertical abutments.

19. The polishing pad of claim 1, wherein the channels are dimensioned and configured to facilitate a polishing process by radially directing a fluid from the inner radius to the outer radius and directing the fluid up to the polishing surface at the outer radius.

20. A polishing pad, comprising:

a polishing surface having an outer circumferential edge, an outer radius spaced from and within the outer circumferential edge, and an inner radius spaced from and within the outer radius; and a plurality of similarly shaped, radially extending tapered channels in the polishing surface that extend from the inner radius to the outer radius, the channels having a first depth at the inner radius and a portion of gradually decreasing depth with increasing radius such that bottom surfaces of the channels intersect the polishing surface at the outer radius, the channels also having a first width at the inner radius and a portion of gradually decreasing width with increasing radius such that opposing sidewalls of the channels intersect one another at the outer radius.

21. The polishing pad of claim 20, wherein the inner radius of the polishing surface is an inner circumferential edge of the polishing surface.

22. The polishing pad of claim 20, wherein the polishing surface further comprises a middle radius spaced from and between the inner radius and the outer radius, the middle radius is closer to the outer radius than to the inner radius, the channels have the first depth between the inner radius in the middle radius, and the channels have the gradually decreasing depth between the middle radius and the outer radius.

23. The polishing pad of claim 22, wherein the channels have the first width and the opposing sidewalls are parallel between the inner radius and the middle radius, and the channels have the gradually decreasing width and opposing sidewalls diagonally converge between the middle radius and the outer radius.

24. The polishing pad of claim 20, wherein the opposing sidewalls curve in a first rotational direction.

25. The polishing pad of claim 20, wherein the gradually decreasing depth extends between the inner radius and the outer radius.

26. The polishing pad of claim 20, wherein the bottom surfaces of the channels include spaced vertical abutments.

27. The polishing pad of claim 20, wherein the channels are dimensioned and configured to facilitate a polishing process by radially directing a fluid from the inner radius to the outer radius and directing the fluid up to the polishing surface at the outer radius.

28. The polishing pad of claim 20, wherein the polishing surface further includes a plurality of similarly shaped, symmetrically spaced circumferential grooves between the outer radius and the outer circumferential edge, the circumferential grooves having a second depth and a second width, with the first depth being substantially greater than the second depth, and the first width substantially greater than the second width.

29. The polishing pad of claim 28, wherein the polishing surface further includes a single circumferential trench between the inner radius and the outer radius, intersecting the radially extending tapered channels, and having a third depth and a third width, with the third depth being substantially greater than the second depth, and the third width being substantially greater than the second width.

30. The polishing pad of claim 29, wherein the first depth is substantially similar to the third depth.

31. The polishing pad of claim 20, wherein the outer radius is spaced from the outer circumferential edge by at least one inch.

32. The polishing pad of claim 20, wherein the first depth is at least 20 mils.

33. The polishing pad of claim 32, wherein the first depth is in the range of 20 to 90 mils.

34. The polishing pad of claim 20, wherein the first width is at least 0.25 inches.

35. A polishing pad for polishing a semiconductor wafer, the pad comprising:

a planar polishing surface having an outer circumferential edge, an inner circumferential edge, and an outer radius therebetween and spaced at least one inch from the outer circumferential edge;

a plurality of similarly shaped, symmetrically spaced, radially extending tapered channels in the polishing surface that extend from the inner circumferential edge to the outer radius, the radially extending tapered channels having a first depth of at least 20 mils at the inner circumferential edge and a portion of gradually decreasing depth with increasing radius such that bottom surfaces of the radially extending tapered channels intersect the polishing surface at the outer radius, the radially extending tapered channels also having a first width at the inner circumferential edge and a portion of gradually decreasing width with increasing radius such that opposing sidewalls of the radially extending tapered channels intersect one another at the outer radius; and a plurality of similarly shaped, symmetrically spaced circumferential grooves in the polishing surface between the outer radius and the outer circumferential edge, the circumferential grooves having a second depth and a second width, with the first depth being substantially greater than the second depth, and the first width substantially greater than the second width.

36. The polishing pad of claim 35, wherein the polishing surface includes a circumferential trench between and spaced from the outer radius and the inner circumferential edge, wherein the circumferential trench intersects the radially extending tapered channels, and the circumferential trench has a third depth and a third width, with the third depth being substantially greater than the second depth, and the third width being substantially greater than the second width.

37. The polishing pad of claim 35, wherein the polishing surface includes a middle radius between the inner radius and the outer radius, the middle radius is closer to the outer radius than to the inner radius, the radially extending tapered channels have the first width where the opposing sidewalls are parallel to one another between the inner radius and a middle radius, and the radially extending tapered channels have the gradually decreasing width where the opposing sidewalls diagonally converge towards one another between the middle radius and the outer radius.

38. The polishing pad of claim 35, wherein the opposing sidewalls continuously curve in a first rotational direction.

39. A method of polishing a semiconductor wafer, comprising:

providing a polishing pad having a polishing surface comprising radially extending tapered channels, wherein the polishing surface includes an inner radius within an outer radius, the channels extend from the inner radius to the outer radius, and the channels taper at the outer radius;

rotating the pad;

introducing a fluid onto the polishing surface; and pressing the polishing surface against the wafer, wherein the channels are dimensioned and configured to facilitate polishing by directing the fluid between the pad and the wafer.

40. A method of polishing a semiconductor wafer, comprising:

providing a polishing pad having a polishing surface comprising a plurality of radially extending tapered channels, wherein the channels extend from an inner radius of the polishing surface to an outer radius of the polishing surface, the outer radius is between the inner radius and an outer circumferential edge of the polishing surface, the channels taper at the outer radius, and the channels are dimensioned and configured to direct a fluid from the inner radius to the outer radius;

mounting a semiconductor wafer on a wafer holder;

rotating the pad in a first rotational direction;

introducing a slurry onto the polishing surface and;

pressing the polishing surface against the wafer while the wafer covers the outer radius, wherein the channels direct the slurry from the inner radius to the outer radius, thereby facilitating polishing the wafer.

41. The method of claim 40, wherein the channels include opposing sidewalls that extend between the inner radius and the outer radius, a first portion adjacent to the inner radius in which the opposing sidewalls are parallel and spaced by a first width and extend a first depth, and a second portion adjacent to the outer radius in which the opposing sidewalls are spaced by a decreasing width with increasing radius and have a decreasing depth with increasing radius.

42. The method of claim 40, wherein the channels have opposing sidewalls that extend between the inner radius and the outer radius, and the opposing sidewalls curve in a second rotational direction opposite to the first rotational direction.

43. The method of claim 40, further comprising:

introducing a cleaning fluid onto the polishing surface after introducing the slurry onto the polishing surface, and;

pressing the polishing surface against the wafer while the wafer is between the inner radius and the outer radius so as to expose the outer radius, wherein the channels direct the cleaning fluid from the inner radius to the outer radius thereby facilitating cleaning the wafer.

44. A method of polishing and cleaning a semiconductor wafer, comprising:

providing a rotating polishing pad with a polishing surface that includes radially extending tapered channels, wherein the polishing surface includes an inner radius within an outer radius, the channels extend from the inner radius to the outer radius, the channels taper at the outer radius, and the outer radius is spaced from an outer circumferential edge of the polishing surface;

pressing the polishing surface against a wafer while the wafer is positioned to cover the outer radius and slurry is present on the polishing surface, thereby planarizing the wafer; and pressing the polishing surface against the wafer while the wafer is positioned to expose the outer radius and cleaning fluid is present on the polishing surface, thereby cleaning the wafer.

45. The method of claim 44, wherein the channels taper laterally and vertically at the outer radius.

46. The method of claim 45, wherein opposing sidewalls of the channels intersect one another at the outer radius, and bottom surfaces of the channels intersect the polishing surface at the outer radius.

47. A polishing system for polishing a semiconductor wafer, comprising:

a polishing pad having a polishing surface comprising radially extending tapered channels, wherein the polishing surface includes an inner radius within an outer radius, the channels extend from the inner radius to the outer radius, the channels taper at the outer radius;

a rotatable platen for removably securing the polishing pad;

a rotatable wafer holder for removably securing a wafer such that the wafer can be pressed against the polishing surface; and a dispenser for dispensing the fluid onto the polishing surface.

48. The system of claim 47, wherein the polishing surface includes an outer circumferential edge, the outer radius is within and spaced from the outer circumferential edge, and the channels taper laterally and vertically at the outer radius.

49. The system of claim 48, wherein opposing sidewalls of the channels intersect one another at the outer radius, and bottom surfaces of the channels intersect the polishing surface at the outer radius.

* * * * *